United States Patent [19]

Lew

[11] Patent Number: 4,759,260

[45] Date of Patent: Jul. 26, 1988

[54] SUPER RELIABLE AIR-SPRING RETURN AIR CYLINDER

[76] Inventor: Yon S. Lew, 7890 Oak St., Arvada, Colo. 80005

[21] Appl. No.: 764,926

[22] Filed: Aug. 12, 1985

Related U.S. Application Data

[63] Continuation-in-part of Ser. No. 125,554, Feb. 28, 1980, which is a continuation-in-part of Ser. No. 907,030, May 17, 1978, Pat. No. 4,226,167.

[51] Int. Cl.[4] ..... F15B 15/22

[52] U.S. Cl. ..... 91/394; 91/416; 91/533; 92/134; 92/151; 92/152

[58] Field of Search ..... 92/130 A, 134, 151, 92/152; 91/234, 325, 394, 415, 416, 533

[56] References Cited

U.S. PATENT DOCUMENTS

| | | | |
|---|---|---|---|
| 2,461 | 1/1867 | James | 92/134 |
| 825,866 | 7/1906 | Rogers | 92/151 |
| 2,981,234 | 4/1961 | Appleton | 92/151 |
| 3,485,141 | 12/1969 | Ott | 92/151 |
| 3,487,752 | 1/1970 | James | 92/134 |
| 3,587,394 | 6/1971 | Hilbrands | 91/417 R |
| 3,908,373 | 9/1975 | Peterson | 92/134 |
| 4,192,222 | 3/1980 | Dits | 92/151 |
| 4,296,677 | 10/1981 | Little | 92/151 |
| 4,550,811 | 11/1985 | Rumsey | 92/130 A |
| 4,633,665 | 1/1987 | Büter | 92/134 |

*Primary Examiner*—Abraham Hershkovitz

[57] ABSTRACT

This invention relates to a fail-safe or auto-return actuator cylinder employing the air spring effect provided by compressed air trapped in an air-spring compartment; which air spring effect replaces the conventional mechanical coil spring employed in conventional fail safe or auto-return air cylinders. The air spring chamber integrally built into the cylinder body is connected to the compressed air supply tube through a check valve that provides the self-charging and self-recharging feature for the air-spring chamber and, consequently, the air-spring chamber remains fully charged with compressed air even when there is a compressed air leak from the air-spring chamber. The air-spring compartment stays charged or becomes automatically recharged even when there is a leak from the air-spring compartment as long as there is compressed air to actuate the cylinder. If there is no compressed air to recharge the air-spring compartment automatically when there is a leak from the air-spring compartment, the cylinder remains at the fail safe position because there is no compressed air to actuate it. Therefore the auto-return feature of the actuator cylinder to the fail-safe position is guaranteed for all instances under all circumstances where there is a failure in the compressed air supply system.

3 Claims, 2 Drawing Sheets

SUPER RELIABLE AIR-SPRING RETURN AIR CYLINDER

This is a continuation-in-part application to patent application Ser. No. 125,554 filed on Feb. 28, 1980, which is a continuation-in-part application to Ser. No. 907,030 filed on May 17, 1978 that is now U.S. Pat. No. 4,226,167. The purpose of this C.I.P. application is to include an embodiment of the airspring return air cylinder that employs diaphragms in place of pistons, which matter was originally included and claimed in the application Ser. No. 907,030. The claims drawn upon the air-spring return air cylinder employing the diaphragms were omitted by an examiner of the U.S. Patent and Trademark Office against the wishes of this applicant and, consequently, U.S. Pat. No. 4,226,167 does not include those claims drawn upon the air-spring return air cylinder employing diaphragms instead of pistons.

BACKGROUND OF THE INVENTION

Without any exception, present day fail-safe or auto-return air cylinders employ mechanical coil springs to provide the force that actuates the cylinder back to the fail-safe position in case of a compressed air supply failure. For air cylinders of large bore diameters, the mechanical coil springs must provide a return force of very large magnitude and, consequently, the size and weight of such mechanical coil springs becomes very large, which makes fail-safe or auto-return air cylinders employing mechanical coil springs very heavy, bulky and expensive. The present invention teaches how to construct a more economic fail-safe or auto-return air cylinder, which is lighter, more compact and cheaper than the conventional air cylinder by factors ranging from two to ten times compared with conventional auto-return air cylinders.

The primary object of the present invention is to provide an automatically returning air cylinder which employs the air-spring effect in place of the mechanical coil springs employed in conventional auto-return air cylinders.

Another object is to provide an automatically returning air cylinder employing the air-spring effect provided by compressed air or gas trapped in the air-spring chamber connected to a compressed air or gas supply through a check valve wherein the check valve provides the "self charging" and "self-recharging" capability of the air-spring chamber even when there is a minor leak from the air-spring chamber.

A further object is to provide an automatically returning air cylinder which is lighter in weight, more compact in bulk, less expensive in cost, and has a more powerful auto-return power compared with conventional auto-return air cylinders employing mechanical coil springs.

Still another object is to provide an automatically returning air cylinder which is as reliable as conventional auto-return air cylinders employing mechanical coil springs.

Still a further object is to provide an automatically returning air cylinder which automatically returns to the fail-safe position when the compressed air supply line supplying the compressed air to the air cylinder is intentionally vented or accidentally fails.

These and other objects of the present invention will become clear as the description thereof proceeds.

BRIEF DESCRIPTION OF THE FIGURES

The present invention may be described with great clarity and specificity by referring to the following figures.

DESCRIPTION OF THE ILLUSTRATED EMBODIMENTS

Figure 1:
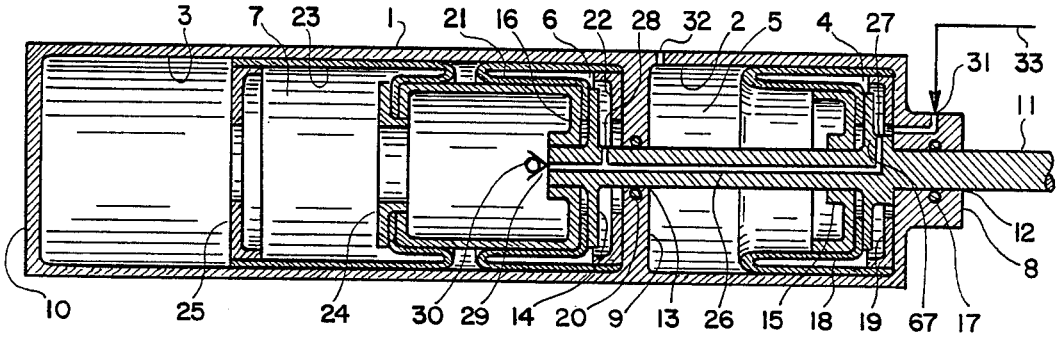
FIG. 1 illustrates a cross section of a super-reliable air-spring return air cylinder taken along a plane including the central axis thereof.

In FIG. 1 there is illustrated a cross section of an embodiment of the air-spring return air cylinder constructed in accordance with the principles of the present invention, which cross section is taken along a plane including the central axis of the air cylinder. The cylindrical body 1 of the air cylinder includes a air of circular cylindrical cavities 2 and 3 disposed in line within the cylindrical body 1, which may have the same or different bore diameters. The circular cylindrical cavity 2 is divided into a pair of compartments 4 and 5 by a slidable partitioning body or diaphragm 18, while the circular cylindrical cavity 3 is divided into another pair of compartments 6 and 7 by another slidable partitioning body or a combination of two diaphragms 21 and 23. The actuator rod 11 engages and extends through a hole 12 disposed through one end wall 8 of the cylindrical body 1 that has the other end wall 10 of solid construction. The actuator rod 11 further engages and extends through another hole 13 disposed through the partitioning wall 9 separating the two cylindrical cavities 3 and 4 from one another. A pair of annular seals 17 and 20 respectively disposed around the holes 12 and 13 prevent the air from leaking across those holes while the sliding movement of the rod 11 through those holes relative to the cylindrical body 1 is allowed. The rod 11 includes a disc 67 rigidly affixed thereto and disposed within the cylindrical cavity 2, to which disc 67 one extremity of the tubular diaphragm 18 is secured in a leak-proof manner. The hollow cylindrical diaphragm support 15 is employed to secure the tubular diaphragm 18 to the disc 67 is well as to support the tubular diaphragm 18 against collapsing when the compartment 4 is pressurized and the compartment 5 is vented. The other extremity of the tubular diaphragm 18 is secured to the cylindrical wall of the cylindrical cavity 2 adjacent to the end wall 8 of the cylindrical cavity 2 in a leak-proof manner by means of a retainer 19 secured to the end wall 8. The rod 11 further includes another disc 14 rigidly affixed thereto and disposed within the cylindrical cavity 3, to which disc 14 one extremity of the tubular diaphragm 21 is secured in a leak-proof manner. The hollow cylindrical diaphragm support 16 is employed to secure the tubular diaphragm 21 to the disc 14 as well as to support the tubular diaphragms 21 and 23 against collapsing when the compartment 6 is pressurized and the compartment 7 is vented or vice versa. The other extremity of the tubular diaphragm 21 is secured to the cylindrical wall of the cylindrical cavity 3 adjacent to the partitioning wall 9 in a leak-proof manner by means of a retainer 22 secured to the partitional wall 9. One extremity of the tubular diaphragm 23 is secured to one extremity of the hollow cylindrical diaphragm support 16 in a leak-proof manner by means of a retainer 24 secured to one extremity thereof, wherein the other extremity of the cylindrical diaphragm support 16 is affixed to the disc 14.

The other extremity of the tubular diaphragm 23 is secured to the cylindrical wall of the cylindrical cavity 3 intermediate the partitioning wall 9 and the other end wall 10 in a leak-proof manner by means of a retainer 25. An air passage 26 is disposed lengthwise within the rod 11 which is open to the compartment 7 at one extremity 29 and to the compartment 4 at the other extremity 27. A check valve 30 included in the air passage 26 allows the compressed air to flow into the compartment 7, while it prevents the compressed air from flowing out of the compartment 7. The air passage 26 has a branch opening 28, that is open to the compartment 6. The compartment 4 has a port 31 to which a compressed air tube 33 is connected. The compartment 5 is vented to the ambient atmosphere by a vent port 32. The compressed air line 33 is connected to a compressed air source through a control valve that directs the compressed air to the port 31 when it is open and cuts off the compressed air and vents port 31 when it is closed.

The air-spring return air cylinder illustrated in FIG. 1 operates in the following manner: when the control valve included in the compressed air line 33 is open, compartments 4, 6 and 7 becomes simultaneously pressurized. The net force on the combination of the disc 14-diaphragm 21 is small as the forces on two sides of the combination of the disc 14 and the diaphragm 21 respectively resulting from the pressure of the compressed air in compartments 6 and 7 nearly cancel each other, as the difference in the effective piston area on two sides of the combination of the disc 14-diaphragm 21 is no greater than the cross section of the rod 11, which is generally much smaller than the bore diameters of the circular cylindrical cavities 2 and 3. As a consequence, the force on the combination of the disc 67-diaphragm 18 resulting from the pressure of the compressed air in the compartment 4 pushes the combination of the disc 67-diaphragm 18 toward the partitioning wall 9. In other words, opening of the control valve included in the compressed air line 33 retracts the rod 11 into the cylinder body 1 and, consequently, the air cylinder becomes retracted. When the control valve is closed, the compartments 4 and 6 become instantly vented while the compartment 7 remains pressurized because of the check valve 30 and, consequently, the pressure of the compressed air trapped in the compartment 7 extends the rod 11. It is crystal clear that the air cylinder retracts when the compressed air is directed to the port 31 and the air cylinder extends when the port 31 is vented intentionally or accidentally. In the specific embodiment shown in FIG. 1, the fully extended position as shown therein is the fail-safe position. When the compressed air is directed to the port 31, the actuator becomes actuated away from the fail-safe position. When the port 31 is vented, the actuator returns to the fail-safe position. Therefore, when the compressed air source fails or the control valve malfunctions accidentally venting the compressed air line 33, the air cylinder automatically returns to the fail-safe position. It should be mentioned that the compartment 7 or the air-spring compartment should have a sufficient capacity in order to maintain an air pressure of sizable level even when the air cylinder is fully extended. Such a capacity may be provided by providing a sufficient volume for the compartment 7 or by connecting the compartment 7 to a sealed air reservoir. It should be understood that the compartment 7 or the air spring chamber has the capability of "self-charging and self-recharging" because the air-spring chamber remains fully charged even when there is a minor leak out of the air-spring chamber, as the compressed air automatically flows into the air-spring chamber through the check valve 30 to replenish whatever amount of the compressed air leaked out of the air spring compartment. An air-spring return air cylinder having the fully retracted position as the fail-safe position can be constructed by modifying the air cylinder shown in FIG. 1 in such a way that the rod 11 engages and extends through a hole disposed through the end wall 10 instead of the end wall 8 in a leak-proof manner. It is also possible to construct an air-spring return air cylinder with the rod engaging and extending through both of two holes respectively disposed through the two end walls 8 and 10. It should be understood that the extremity of the rod 11 must include means for connecting thereof to equipment to be actuated or for anchoring to a support structure. It is also clear that the cylinder body 1 must have means for anchoring thereof to a support structure or to equipment to be actuated. For the brevity of the illustration, these means for connecting or anchoring are not included in the illustrated embodiment shown in FIGS. 1 through 10. It should be understood that those illustrative embodiments shown in FIGS. 1 through 10 having the fully extended position as the fail-safe position may be modified to embodiments having the fully retracted position as the fail-safe position.

Figure 2:
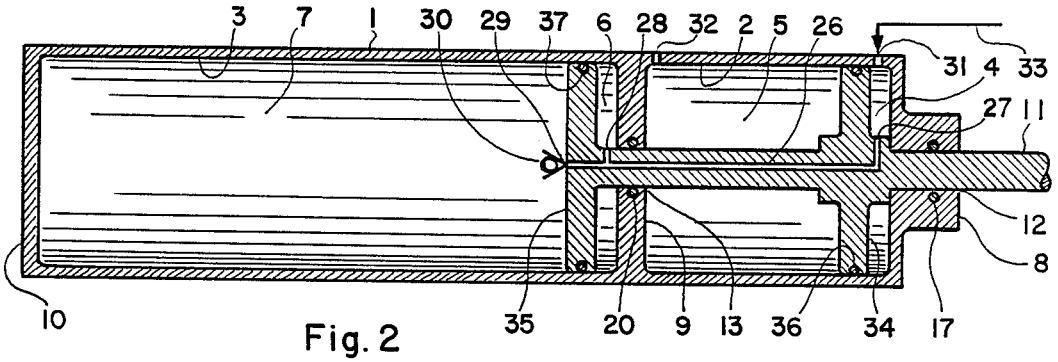
FIG. 2 illustrates a cross section of another embodiment of the super-reliable air-spring return air cylinder constructed in accordance with the principles of the present invention.

In FIG. 2 there is illustrated another embodiment of the air-spring return air cylinder wherein the first slidable partitioning body dividing the first cylindrical cavity 2 into two compartments 4 and 5 in a leak-proof manner comprises the combination of the piston 34 and annular seal 36, while the second slidable partitioning body dividing the second cylindrical cavity 3 into two compartments 6 and 7 comprises the combination of the piston 35 and annular seal 37. Other than the piston-seal combinations replacing the disc-tubular diaphragm combinations, the air-spring return air cylinder of FIG. 2 has the same construction and operating principles as that of FIG. 1.

Figure 3:
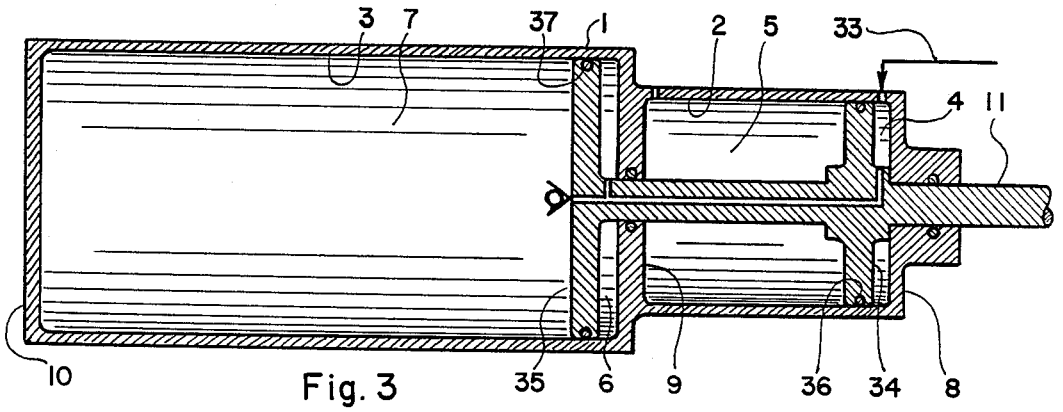
FIG. 3 illustrates a cross section of a super-reliable air-spring return air cylinder employing an air-spring chamber of diameter greater than the diameter of the actuator chamber.

In FIG. 3 there is illustrated a further embodiment of the air-spring return air cylinder having the same construction as that shown in FIG. 2 with one exception being that the bore diameter of the cylindrical cavity including the air-spring compartment and the bore diameter of the cylindrical cavity including the vented compartment are made different from one another, wherein the former may be greater than the latter as shown in FIG. 3 or the latter may be made greater than the former in other embodiments. It should be understood that the piston-annular seal combinations employed in the embodiment shown in FIG. 3 may be replaced with the disc-tubular diaphragm combination, as exemplified in FIG. 1.

Figure 4:
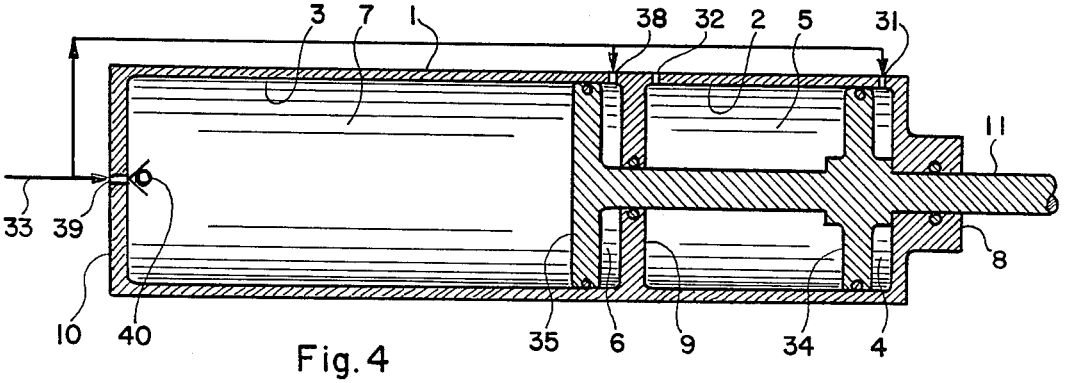
FIG. 4 illustrates a cross section of a further embodiment of the super-reliable air-spring return air cylinder constructed essentially in the same way as that of FIG. 1 with one exception being that the compressed air passage is routed differently from that shown in FIG. 1.

In FIG. 4 there is illustrated yet another embodiment of the air-spring return air cylinder constructed in essentially the same way as that shown in FIG. 2 with one exception being that the compressed air supply routing to the three compartments 4, 6 and 7 includes three independent ports 31, 38, 39 respectively open to the compartments 4, 6 and 7. The port 39 directing the compressed air to the compartment 7 or the air-spring compartment includes a check valve 40. In this embodiment, the control valve may be installed in the compressed air line in one of two ways wherein either the compressed air supplied to all three compartments 4, 6 and 7 flows through the control valve or the compressed air supplied to the compartments 4 and 6 only flows through the control valve as the control valve is installed at a down stream point from the branching compressed air line connected to the compartment 7. It should be understood that an air-spring return air cylinder similar to that shown in FIG. 4 can be constructed by using the disc-tubular diaphragm combinations in place of the piston-annular seal combinations, as exemplified in FIG. 1.

Figure 5:
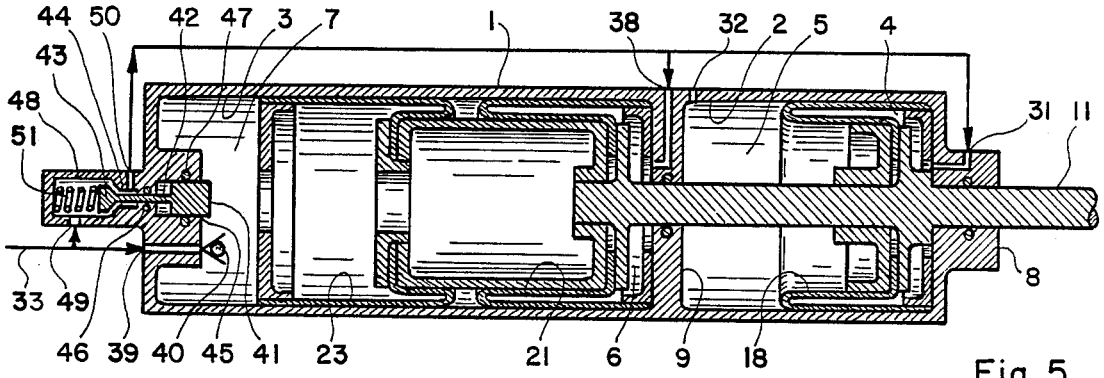
FIG. 5 illustrates a cross section of a further embodiment of the super-reliable air-spring return air cylinder including means for assuring the charging of the air-spring chamber prior to the actuation of the air cylinder.

In FIG. 5, there is shown yet a further embodiment of the air-spring return air cylinder constructed in the same way as that shown in FIG. 1 with the exception of the compressed air supply system. In the embodiment shown in FIG. 5, the compressed air is directed supplied to the compartment 7 through port 39 equipped with a check valve 40, while the compressed air supply to the compartments 4 and 6 are controlled by a safety valve 43 seating on a seat 44. The safety valve 43 remains closed on said seat 44 because of a spring 51 as long as the compartment 7 is not fully pressurized. When the compartment 7 is fully pressurized, the force on the base of the piston 41 exerted by pressure of the compressed air in the compartment 7 lifts the valve 43 from the seat 44 against the spring 51, which action allows the compressed air entering the cavity 48 through a port 49 from the compressed air line 33 to flow through the valve and out of port 50 and into the compartment 6 through the port 38 and to the compartment 4 through the port 31. A pair of annular seals 46 and 47 respectively disposed around the stem 42 and piston 41 engaging hole 45 isolate the force on said piston system. With this arrangement, the air-spring chamber becomes always recharged before the air cylinder is retracted, which provides an additional guarantee for automatically returning the air cylinder to the fail-safe-position when the compressed air line is intentionally vented or accidentally depressurized. This is an additional safety feature providing a greater reliability compared with those air-spring return air cylinders wherein the air-spring compartment is charged simultaneously with the actuating compartments.

Figure 6:
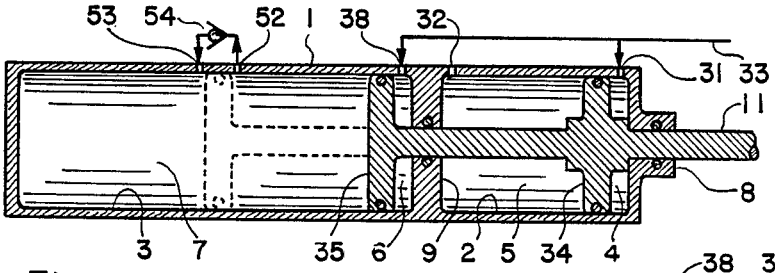
FIG. 6 illustrates a cross section of yet another embodiment of the super-reliable air-spring return air cylinder including means for charging or recharging the air-spring chamber only after the air cylinder is actuated away from the fail-safe position to a preset position.

In FIG. 6, there is shown an embodiment employing means for allowing the compressed air to flow into the compartment 7 only when the air cylinder becomes actuated to a certain preset position. In FIG. 6, the position of the piston shown in broken line within the cylindrical cavity 3 illustrates the position of said piston when the air cylinder is actuated to a preset position. In this embodiment, the compressed air flows directly into the compartments 4 and 6 through ports 31 and 38, respectively. However, the compressed air is allowed to enter the compartment 7 through ports 52 and 53 through a check valve 54 included therebetween only when the air-spring return actuator cylinder is actuated to a preset position opposite to the fail-safe position.

Figure 7:
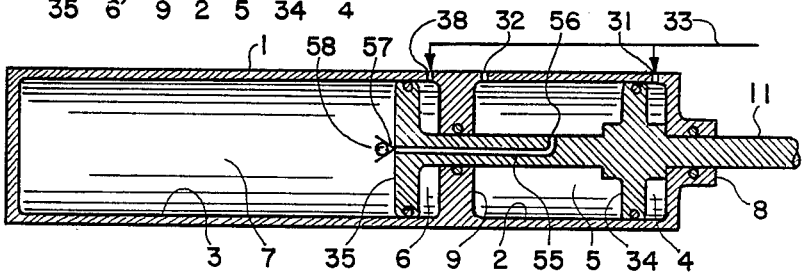
FIG. 7 illustrates a cross section of yet a further embodiment of the super reliable air-spring return air cylinder including means for charging or recharging the air-spring chamber only after the air cylinder is actuated away from the fail-safe position to a preset position.

In FIG. 7, there is illustrated another embodiment of the air-spring return actuator cylinder including the compressed air passage to the compartment 7 routed differently compared with that illustrated in FIG. 6, that provides the same function as that included in the air-spring return air cylinder shown in FIG. 6. Herein, a compressed air passage 55 with one opening 56 disposed on the cylindrical surface of the rod 11 and the other opening 57 open to the compartment 7 through a check valve 58 is disposed lengthwise through the rod 11. The opening 56 of the compressed air passage 55 is located at such a position that it crosses the annular seal installed in the hole disposed through the partitioning wall 9 only when the air-spring return acutator cylinder is actuated to a preset position which may be the fully retracted position. As a consequence, the compressed air is allowed to enter the compartment 7 from the compartment 6 through the compressed air passage 55 only after the actuator cylinder is actuated to a preset position opposite to the fail-safe position.

Figure 8:
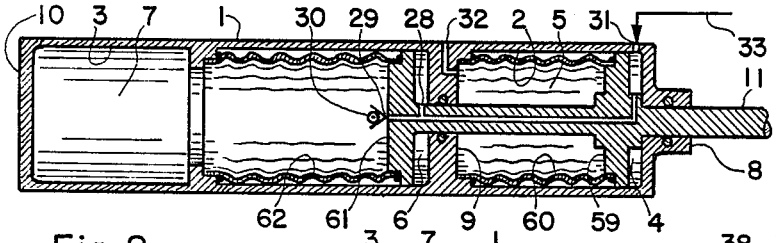
FIG. 8 illustrates a cross section of a super-reliable air-spring return air cylinder constructed in essentially the same way as that of FIG. 1 with one exception being that bellows are employed in place of the diaphragms shown in FIG. 1.

In FIG. 8 there is illustrated a cross section of an embodiment of the air-spring return actuator cylinder constructed in essentially the same way as that shown in FIG. 1 with one exception being that bellows 60 and 62 are employed in place of the diaphragm 18, and the combination of diaphragms 21 and 23, respectively. One extremity of the bellows 60 is affixed to a guide piston 59 in a leak-proof fashion while the other extremity is affixed to the cylindrical wall of the circular cylindrical cavity 2 adjacent to the partitioning wall 9 in a leak-proof fashion. One extremity of the bellows 62 is affixed to the guide piston 61 in a leak-proof fashion while the other extremity is affixed to the cylindrical wall of the circular cylindrical cavity 3 intermediate the partitioning wall 9 and the end wall 10 in a leak-proof fashion. It should be understood that the guide pistons 59 and 61 are not leak-proof barriers as they lack any annular seals.

Figure 9:
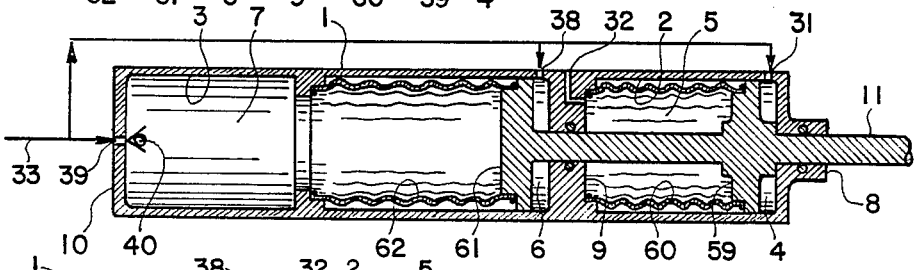
FIG. 9 illustrates a cross section of another embodiment of the superreliable air-spring return air cylinder employing bellows.

In FIG. 9 there is illustrated a cross section of another embodiment of the air-spring return actuator cylinder constructed in essentially the same way as the actuator cylinder shown in FIG. 8 with one exception being that the compressed air passage thereof employs the same routing as that employed in FIG. 4 instead of that of FIG. 8. It should be understood that, as mentioned in conjunction with FIG. 4, the compressed air line connected to the airspring compartment 7 may be branched off from the compressed air line connected to the compartments 4 and 6 upstream or downstream of the control valve controlling the compressed air flow to the actuator cylinder.

Figure 10:
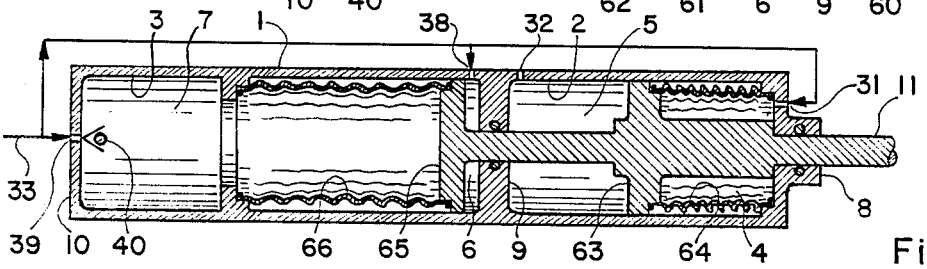
FIG. 10 illustrates a cross section of a further embodiment of the superreliable air-spring return air cylinder employing bellows.

In FIG. 10 there is illustrated a cross section of a further embodiment of the air-spring return actuator cylinder constructed in essentially the same way as the actuator air cylinder shown in FIG. 9 with one exception being that the bellows 64 is installed differently from the bellows 60 included in FIG. 9, while the bellows 6 is installed in the same way as the bellows 62 included in FIG. 9. One extremity of the bellows 64 is affixed to the end wall 8 in a leak-proof fashion while the other extremity is affixed to the guide piston 63 in a leak-proof fashion. The guide pistons 63 and65 are not leak-proof barriers. It should be understood that the bellows 60 included in the actuator cylinder shown in FIG. 8 may be installed in the same way as the bellows 64 included in FIG. 10. The installation of the bellows as shown in FIG. 10 provides an advantage in that the bellows 64 and 66 are subjected to an inflating loading only, wherein the cylindrical walls of the circular cylindrical cavities 2 and 3 act like a containment wall protecting the bellows 64 and 66 against dilation. It should be understood that the embodiments of the air-spring return actuator cylinders shown in FIGS. 3, 5, 6 and 7 may be constructed by employing the bellows installed as shown in FIGS. 8, 9 and 10 in place of the tubular diaphragms or the pistons. It is clear that the use of the pistons, tubular diaphragms and bellows in constructing the air-spring return actuator cylinders shown in FIGS. 1 through 10 is interchangeable.

While the principles of the present invention have now been made clear by the illustrative embodiments, there will be immediately obvious to those skilled in the art many modifications of the structures, arrangements. proportions, the elements, materials and components which are particularly adapted for the specific working environments and operating conditions in the practice of the invention without departing from those principles.

I claim:

1. An air-spring return actuator cylinder comprising in combination:

(a) a cylindrical body including a first cylindrical cavity and a second cylindrical cavity disposed substantially in line to one another;

(b) an actuator rod slidably engaging and extending through at least a first hole disposed through at least one end wall of said cylindrical body and through a second hole disposed through a partitioning wall separating said first and second cylindrical cavities in a leak-proof fashion wherein said actuator rod is disposed in a substantially coaxial relationship with respect to said first and second cylindrical cavities;

(c) a first slidable partitioning body rigidly affixed to said actuator rod in a coaxial relationship and slidably disposed in said first cylindrical cavity, said first slidable partitioning body dividing said first cylindrical cavity into a first and a second compartment in a leak-proof fashion;

(d) a second slidable partitioning body rigidly affixed to said actuator rod in a coaxial relationship and slidably disposed in said second cylindrical cavity, said second slidable partitioning body dividing said second cylindrical cavity into a third and a fourth compartment in a leak-proof fashion;

(e) a first port open to said first compartment and open to a common pressure source;

(f) a vent port open to said second compartment for venting said second compartment;

(g) a second port open to said third compartment and open to said common pressure source;

(h) a third port open to said fourth compartment and open to said common pressure source; and (i) a check valve included in a compressed air passage through said third port wherein said check valve allows the compressed air to flow into said fourth compartment and prevents the compressed air trapped in said fourth compartment from flowing out of said fourth compartment; whereby, said check valve provides self-charging and self-recharging capability for said fourth compartment producing air-spring effect that automatically actuates said air-spring return actuator cylinder to a fail-safe position when said first and third compartments are intentionally or accidentally depressurized;

whereby, pressurization of said first and third compartments actuates said air-spring return actuator cylinder to a position opposite to said fail-safe position and intentional or accidental depressurization of said first and third compartments automatically actuates said air-spring return actuator cylinder back to said fail-safe position.

2. An air-spring return actuator cylinder comprising in combination:

(a) a cylindrical body including a first cylindrical cavity and a second cylindrical cavity disposed substantially in line to one another;

(b) an actuator rod slidably engaging and extending through at least a first hole disposed through at least one end wall of said cylindrical body and through a second hole disposed through a partitioning wall separating said first and second cylindrical cavities in a leak-proof fashion wherein said actuator rod is disposed in a substantially coaxial relationship with respect to said first and second cylindrical cavities;

(c) a first slidable partitioning body rigidly affixed to said actuator rod in a coaxial relationship and slidably disposed in said first cylindrical cavity, said first slidable partitioning body dividing said first cylindrical cavity into a first and a second compartment in a leak-proof fashion;

(d) a second slidable partitioning body rigidly affixed to said actuator rod in a coaxial relationship and slidably disposed in said second cylindrical cavity, said second slidable partitioning body dividing said second cylindrical cavity into a third and a fourth compartment in a leak-proof fashion;

(e) a first port open to said first compartment and open to a common pressure source;

(f) a vent port open to said second compartment for venting said second compartment;

(g) a second port open to said third compartment and open to said common pressure source;

(h) a third port open to said fourth compartment and open to said common pressure source; and (i) a check valve included in a compressed air passage through said third port wherein said check valve allows the compressed air to flow into said fourth compartment and prevents the compressed air trapped in said fourth compartment from flowing out of said fourth compartment; whereby, said check valve provides self-charging and self-recharging capability for said fourth compartment producing air-spring effect that automatically actuates said air-spring return actuator cylinder to a fail-safe position when said first and third compartments are intentionally or accidentally depressurized;

(j) a means for allowing the compressed air into said first and third compartments only after said fourth compartment is properly pressurized;

whereby, pressurization of said first and third compartments actuates said air-spring return actuator cylinder to a position opposite to said fail-safe position and intentional or accidental depressurization of said first and third compartments automatically actuates said air-spring return actuator cylinder back to said fail-safe position.

3. An air-spring return actuator cylinder comprising in combination:

(a) a cylindrical body including a first cylindrical cavity and a second cylindrical cavity disposed substantially in line to one another;

(b) an actuator rod slidably engaging and extending through at least a first hole disposed through at least one end wall of said cylindrical body and through a second hole disposed through a partitioning wall separating said first and second cylindrical cavities in a leak-proof fashion wherein said actuator rod is disposed in a substantially coaxial relationship with respect to said first and second cylindrical cavities;

(c) a first slidable partitioning body rigidly affixed to said actuator rod in a coaxial relationship and slidably disposed in said first cylindrical cavity, said first slidable partitioning body dividing said first cylindrical cavity into a first and a second compartment in a leak-proof fashion;

(d) a second slidable partitioning body rigidly affixed to said actuator rod in a coaxial relationship and slidably disposed in said second cylindrical cavity, said second slidable partitioning body dividing said second cylindrical cavity into a third and a fourth compartment in a leak-proof fashion;

(e) a first port open to said first compartment and open to a common pressure source;

(f) a vent port open to said second compartment for venting said second compartment;

(g) a second port open to said third compartment and open to said common pressure source;

(h) a third port open to said fourth compartment and open to said common pressure source; and (i) a check valve included in a compressed air passage through said third port wherein said check valve allows the compressed air to flow into said fourth compartment and prevents the compressed air trapped in said fourth compartment from flowing out of said fourth compartment; whereby, said check valve provides self-charging and self-recharging capability for said fourth compartment producing air-spring effect that automatically actuates said air-spring return actuator cylinder to a fail-safe position when said first and third compartments are intentionally or accidentally depressurized;

(j) a means for allowing the compressed air into said fourth compartment only after said air-spring return actuator cylinder is actuated to a preset position opposite to said fail-safe position;

whereby, pressurization of said first and third compartments actuates said air-spring return actuator cylinder to a position opposite to said fail-safe position and intentional or accidental depressurization of said first and third compartments automatically actuates said air-spring return actuator cylinder back to said fail-safe position.

* * * * *